US006646189B2

(12) United States Patent
Minakuchi

(10) Patent No.: US 6,646,189 B2
(45) Date of Patent: Nov. 11, 2003

(54) BODY STRUCTURE OF STRINGED INSTRUMENT

(75) Inventor: Kiyoshi Minakuchi, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/878,832

(22) Filed: Jun. 11, 2001

(65) Prior Publication Data

US 2001/0052281 A1 Dec. 20, 2001

(30) Foreign Application Priority Data

Jun. 13, 2000 (JP) ..... 2000-177244

(51) Int. Cl.[7] ..... G10D 3/00
(52) U.S. Cl. ..... 84/291; 84/267; 84/290
(58) Field of Search ..... 84/291, 292, 267, 84/290

(56) References Cited

U.S. PATENT DOCUMENTS 3,771,408 A * 11/1973 Wright ..... 84/267
4,290,336 A * 9/1981 Peavey
4,359,923 A * 11/1982 Brunet ..... 84/267
5,682,003 A * 10/1997 Jarowsky

FOREIGN PATENT DOCUMENTS

DE 2841029 * 3/1980
JP 55-2460 1/1980
JP 2000-276167 10/2000

OTHER PUBLICATIONS

European Patent Office Search Report dated Mar. 4, 2002.*

* cited by examiner

*Primary Examiner*—Shih-Yung Hsieh
(74) *Attorney, Agent, or Firm*—Dickstein, Shapiro, Morin & Oshinsky, LLP.

(57) ABSTRACT

A stringed instrument such as an electric guitar has a specially designed body structure, which is configured by a body frame, a center block, at least one bridge, a front board, a back board and a back cover. The bridge is arranged between a side portion of the body frame and a side wall of the center block, thus partitioning an interior space of the body frame to provide a vacant space for arranging electrical parts. Because of the provision of the bridge, it is possible to improve rigidity of the body structure. Herein, the vacant space is reduced in size and area, and it is encompassed by the side portion of the body frame, the side wall of the center block and the bridge. The front board is used to completely cover the front side of the body frame. The back board is partially cut out and is used to cover the back side of the body except for the opening area of the vacant space inside of the body frame. The back cover is detachably attached to the back side of the body frame in conformity with a cutout of the back board. Because the back cover has a restricted size and shape for merely covering the opening area of the vacant space in the backside of the body, it is possible to prevent the back cover from easily resonating with sounds produced by plucking the strings of the stringed instrument. Thus, it is possible to improve the sound quality as well as the appearance of the backside of the stringed instrument.

14 Claims, 8 Drawing Sheets

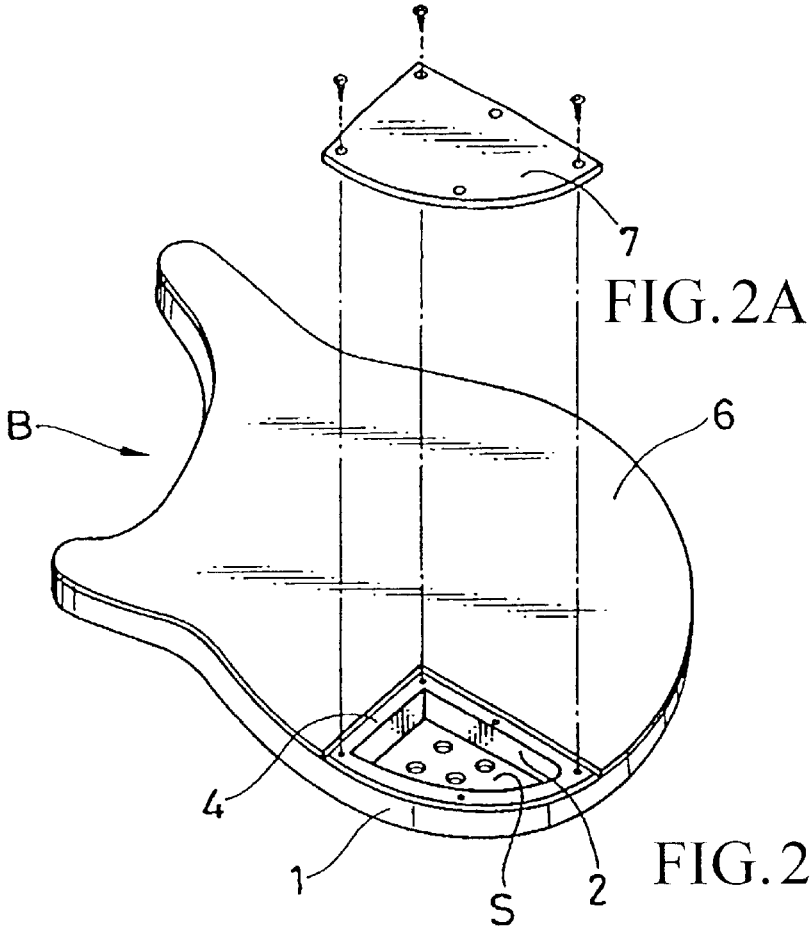
FIG. 2A
FIG. 2B
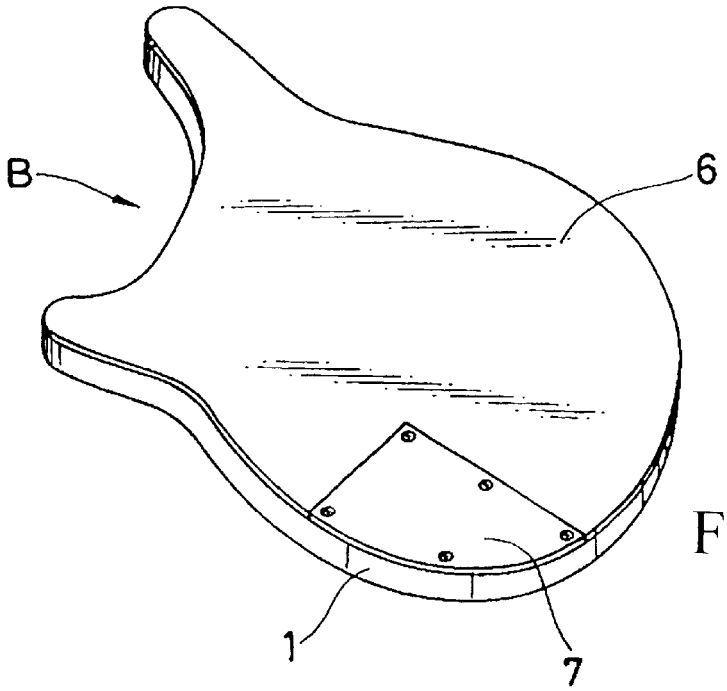
FIG. 3

BODY STRUCTURE OF STRINGED INSTRUMENT

BACKGROUND OF THE INVENTION

1. Field of the Invention

This invention relates to improvements of body structures of stringed instruments such as electric guitars.

2. Description of the Related Art

Conventionally, various kinds of stringed instruments such as electric guitars are known. The basic configuration of an electric guitar is shown in FIG. 5, wherein a neck 31 is connected to a body 30, and strings 32 are stretched under tension between tuning pegs 33 and a tailpiece 34. Pickups 35 are arranged on the body 30 to detect vibrations of the strings 32, which are converted to electric signals. Herein, electric wiring is arranged such that the electric signals are sent to a volume unit (not shown), which is built in the body 30 and which is varied and adjusted by tone controls 36.

To play music, the player intensely plucks the strings 32 of the electric guitar and operates variable resistor(s) of the volume unit frequently. For this reason, abrasion and mechanical troubles easily occur in electric guitars. The variable resistor is configured such that a sliding member slides on the resistor surface. The resistor surface is easily damaged or abraded if the player operates the variable resistor very frequently. Further, the resistor surface may become oxidized if the user does not operate the variable resistor of the electric guitar for a long time. Abrasion or oxidation of the resistor surface of the variable resistor may cause noise in the sound of the electric guitar. Or, the electric guitar may have problems in which sound signals cannot be output due to imperfect contacts of the variable resistor.

To cope with the aforementioned problems, the electric guitar should be configured such that its electrical parts can be easily replaced with new ones. For example, an electric guitar of a solid type employs a specific structure, a partial exploded view of which is shown in FIGS. 6A and 6B. FIG. 6A shows a body 40 made of the pure wood material. A selected area of a backside of the body 40 is bored to form a hollow portion 41 for arranging electrical parts such as the variable resistor. The opening of the hollow portion 41 is covered with a back cover 42 (see FIG. 6B), which is fixed to the backside of the body 40 by wood screws. Thus, it is possible to easily cope with replacement of the electrical parts by merely detaching the back cover 42 from the body 40.

The present applicant has proposed an electric guitar of a semi-acoustic type, which is disclosed by Japanese Patent Unexamined Publication No. 2000-276167. This electric guitar provides a center block, and a storage portion of electrical parts is made hollow. This raises difficulties in applying the aforementioned structure specially designed for use in an electric guitar of the solid type to an electric guitar of the semi-acoustic type.

Therefore, the electric guitar of the semi-acoustic type employs another type of body structure, an exploded view of which is shown in FIGS. 7A–7D. As shown in FIG. 7B, a center block 52 is placed to engage with a space that is formed between ribs 51 of a body frame 50, which is formed of metal material or synthetic resin. A front board 55 shown in FIG. 7A is adhered to the body frame 50 and the front side of the center block 52. A back board 56 shown in FIG. 7C is adhered to the body frame 50 such that it covers a through hole 53 and the back side of the center block 52.

FIGS. 8A and 8B show a partial exploded view containing perspective illustrations of the prescribed parts of the body structure of the electric guitar. When the back board 56 is adhered to the body frame 50 as shown in FIG. 8B, a through hole 54 is opened to the rear of the body frame 50. There is provided a back cover 57 (see FIG. 8A) whose shape matches with contours of the body frame 50 and rib 51 in connection with the opening of the through hole 54. Fixing the back cover 57 to them by vises (or small screws) 58, it is possible to assemble together all parts of the body as shown in FIG. 9. Herein, the back cover 57 is detachably attached to the backside of the body frame 50, which allows maintenance and replacement of the electrical parts that are arranged inside of the through hole 54 within the body of the electric guitar.

In the aforementioned body structure conventionally employed in electric guitars, the back cover 57 occupies a relatively large area over an entire backside area of the body. This is not preferable in terms of the appearance and sound quality of the electric guitar.

Particularly, the back cover 57 is not adhered but is merely attached to the back side of the body frame 50 by vises 58. This gives rise to problems due to the inappropriate body structure in which resonance easily occur in the guitar's sound, so it is hard to maintain the stable performance of the electric guitar. In addition, this raises various problems due to reduction of the rigidity of the body structure of the electric guitar.

SUMMARY OF THE INVENTION

It is an object of the invention to provide a body structure of a stringed instrument such as an electric guitar in which sound quality, rigidity and appearance are improved by minimizing the area specifically occupied by a back cover covering a storage of electrical parts within the body.

The present invention provides a stringed instrument such as an electric guitar with a specially designed body structure, which is configured by a body frame, a center block, at least one bridge, a front board, a back board and a back cover. The bridge is arranged between a side portion of the body frame and a side wall of the center block, thus partitioning the interior space of the body frame to provide a vacant space for storing electrical parts. Because of the provision of the bridge, it is possible to improve the rigidity of the body structure. Herein, the vacant space is reduced in size and area, and it is encompassed by the side portion of the body frame, side wall of the center block and the bridge. The front board is used to completely cover the front side of the body frame. The back board is partially cut out and is used to cover the back side of the body except for an opening area of the vacant space inside of the body frame. The back cover is detachably attached to the back side of the body frame in conformity with the cutout of the back board. Because the back cover has a restricted size and shape for merely covering the opening area of the vacant space in the backside of the body, it is possible to inhibit the back cover from easily resonating with the sounds produced by plucking the strings of the stringed instrument. Thus, it is possible to improve the sound quality as well as the appearance of the backside of the stringed instrument.

The aforementioned body frame and bridges can be integrally formed together by using metal material or synthetic resin. In addition, it is possible to further provide ribs for reinforcing the body, which are arranged along the side walls of the center block. In that case, the body frame, bridges and ribs can be integrally formed together by using metal material or synthetic resin.

BRIEF DESCRIPTION OF THE DRAWINGS

These and other objects, aspects and embodiments of the present invention will be described in more detail with reference to the following drawing figures, of which:

FIG. 2A shows a perspective illustration of the back cover in a partial exploded view of the body structure of the electric guitar;

FIG. 2B shows a perspective illustration of the backside of a body in the partial exploded view of the body structure of the electric guitar;

FIG. 3 is a perspective view showing the back side of the body to which the back cover is attached;

DESCRIPTION OF THE PREFERRED EMBODIMENT

This invention will be described in detail by way of examples with reference to the accompanying drawings.

The preferred embodiment describes a body structure for use in an electric guitar that represents an example of a stringed instrument. Of course, the body structure of the present embodiment can be widely used for other types of the stringed instruments.

Figure 1A:
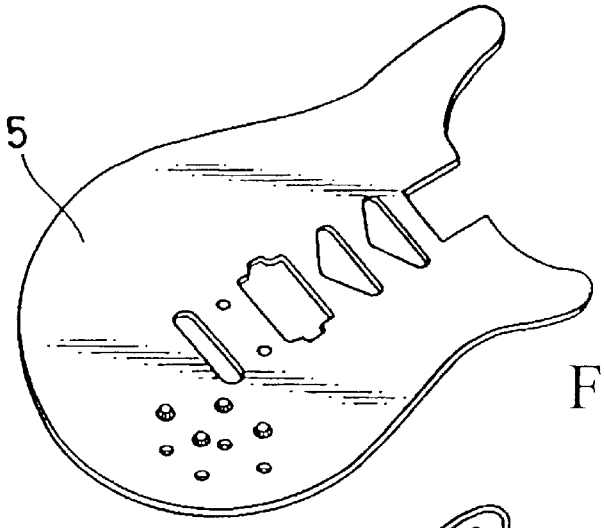
FIG. 1A shows a perspective illustration of a front board in an exploded view of a body structure of an electric guitar in accordance with a preferred embodiment of the invention.
Figure 1B:
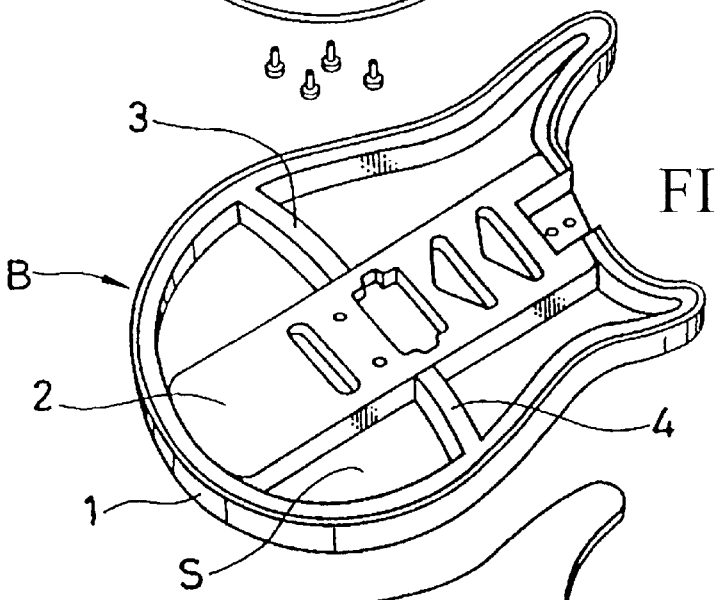
FIG. 1B shows a perspective illustration of a body frame that contains a center block and bridges in the exploded view of the body structure of the electric guitar.
Figure 1C:
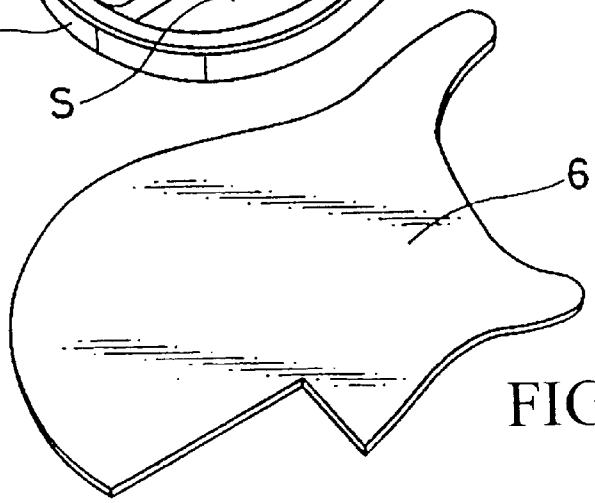
FIG. 1C shows a perspective illustration of a back board in the exploded view of the body structure of the electric guitar.
Figure 1D:
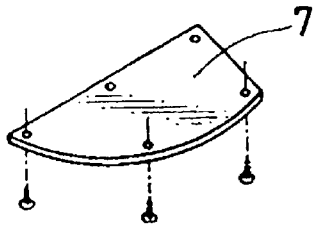
FIG. 1D shows a perspective illustration of a back cover in the exploded view of the body structure of the electric guitar.

FIGS. 1A to 1D show an exploded view containing perspective illustrations of the parts of the body structure of the electric guitar, which are assembled together in accordance with the present embodiment of the invention. Reference numeral 1 designates a body frame (see FIG. 1B) that configures a body B of the electric guitar. The body frame 1 has a complicated internal configuration, which is made by mechanical formation using bent wood members or which is integrally formed of prescribed materials such as metals and synthetic resins. Reference numeral 2 designates a center block for arranging string stretchers and pickup devices. The center block 2 is arranged approximately in the central area of the body frame 1 along its longitudinal direction.

Reference numerals 3 and 4 designate bridges that extend between and are arranged between the center block 2 and the side portions of the body frame 1. It is possible to form the bridges 3, 4 independently of the body frame 1, or it is possible to form the bridges 3, 4 integrally together with other parts of the body frame 1. The bridges 3, 4 function to maintain the interior spaces of the body frame 1 and to support and define the body frame 1 with a prescribed shape. In addition, the bridges 3, 4 partition the interior spaces of the body frame 1 into four sections. Particularly, the bridge 4 defines a vacant space S for arranging the electrical parts of the electric guitar.

After formation of the body frame 1 configuring the body B of the electric guitar, a front board 5 (see FIG. 1A) is adhered to the surfaces of the body frame 1 and its related parts. Thus, the front board 5 is fixed to the body frame 1 of the body B. In addition, there is provided a back board 6, a prescribed section of which is cut out in conformity with the vacant space S within the body frame 1. The back board 6 is adhered to the backside of the body frame 1.

After fixing the front board 5 and back board 6 to the body frame 1, the backside of the body B is configured as shown in FIG. 2B. That is, only the vacant space S is open in the backside of the body B. Then, a back cover 7 (see FIG. 2A) is fixed to this opening of the vacant space S of the body B by vises. Thus, it is possible to complete the backside of the body B entirely as shown in FIG. 3.

Figure 4A:
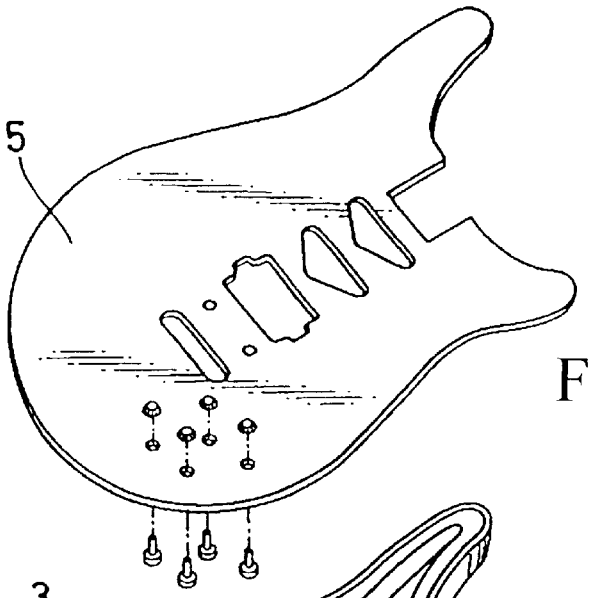
FIG. 4A shows a perspective illustration of the front board in an exploded view of a modified body structure of an electric guitar in accordance with a modified example of the embodiment of the invention.
Figure 4B:
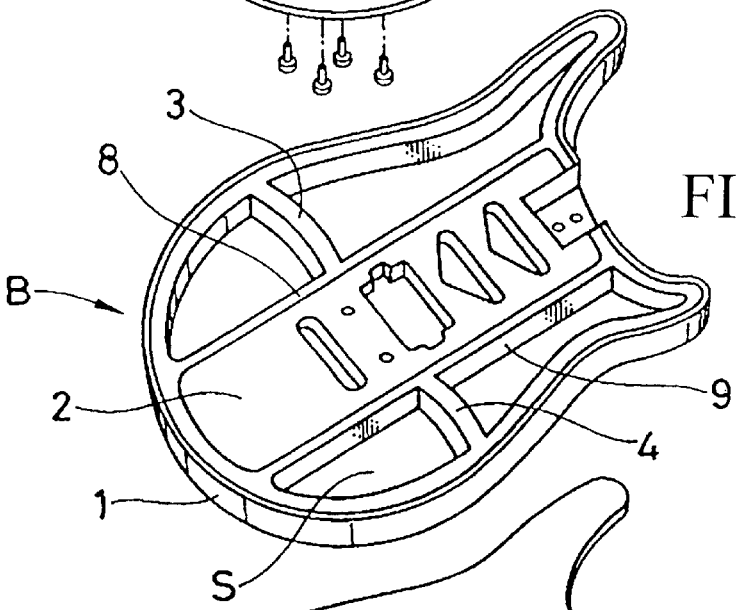
FIG. 4B shows a perspective illustration of a body frame that contains ribs in addition to a center block and bridges in the exploded view of the modified body structure of the electric guitar.
Figure 4C:
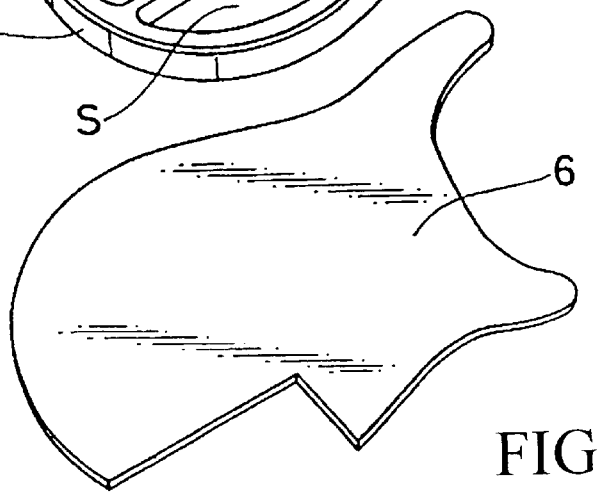
FIG. 4C shows a perspective illustration of the back board in the exploded view of the modified body structure of the electric guitar.
Figure 4D:
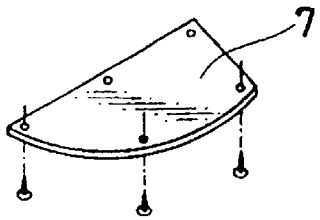
FIG. 4D shows a perspective illustration of a back cover in the exploded view of the modified body structure of the electric guitar.
Figure 5:
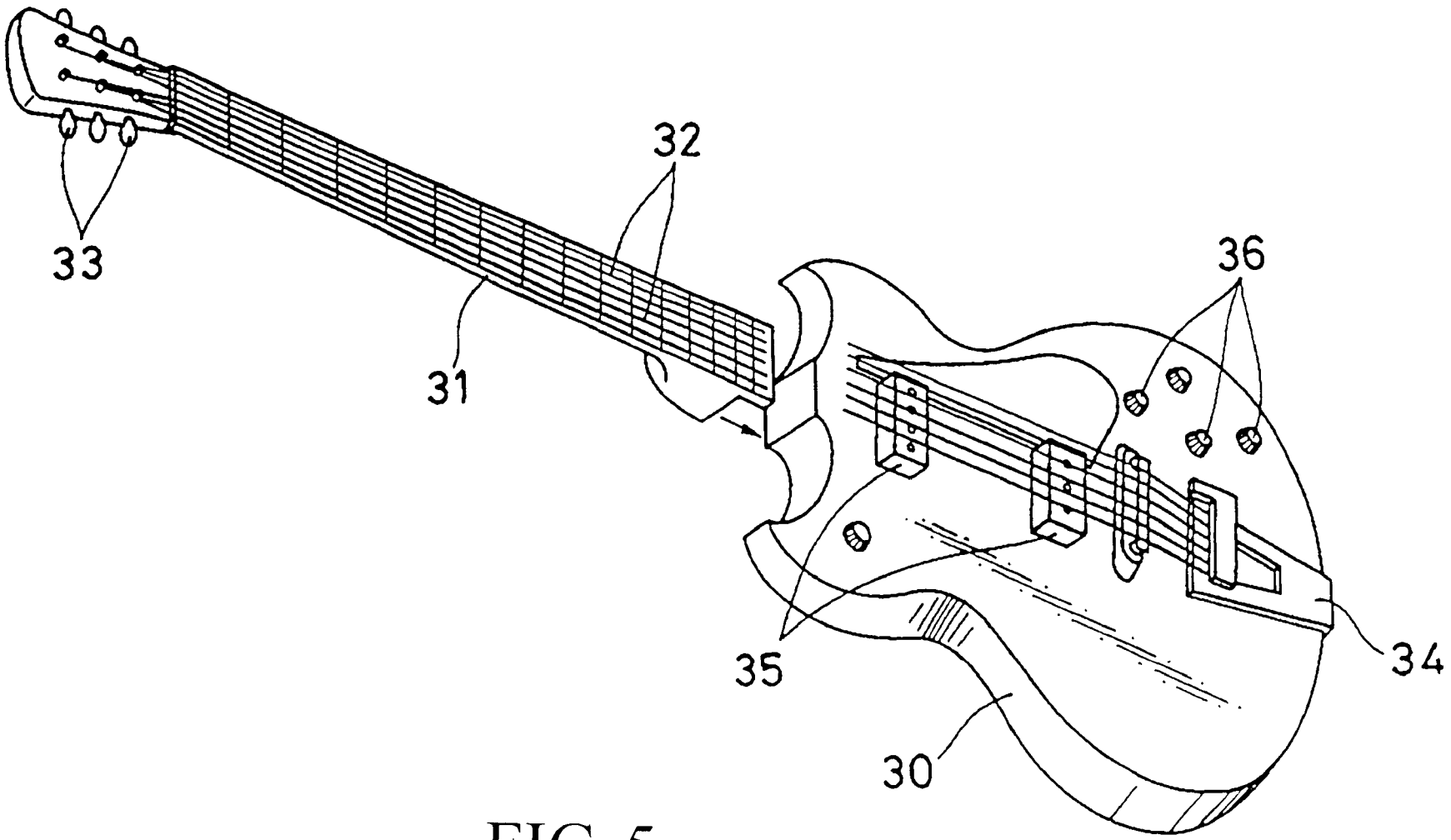
FIG. 5 is a perspective view showing an appearance of an electric guitar that is conventionally known.
Figures 6A, 6B:
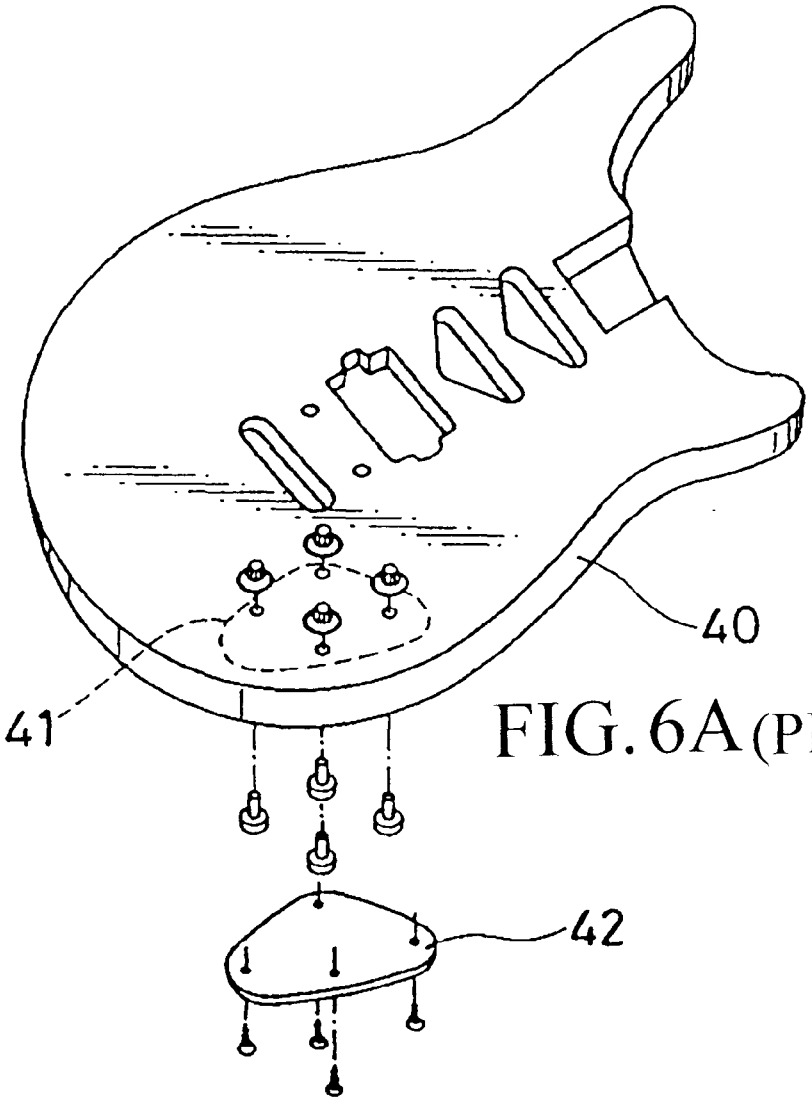
FIG. 6A (PRIOR ART)
FIG. 6B (PRIOR ART)
FIG. 6A shows a perspective illustration of a body in a partial exploded view of a body structure of an electric guitar of the solid type.
FIG. 6B shows a perspective illustration of a back cover that covers an opening of the hollow portion of the body in the partial exploded view of the body structure of the electric guitar.
Figure 7A:
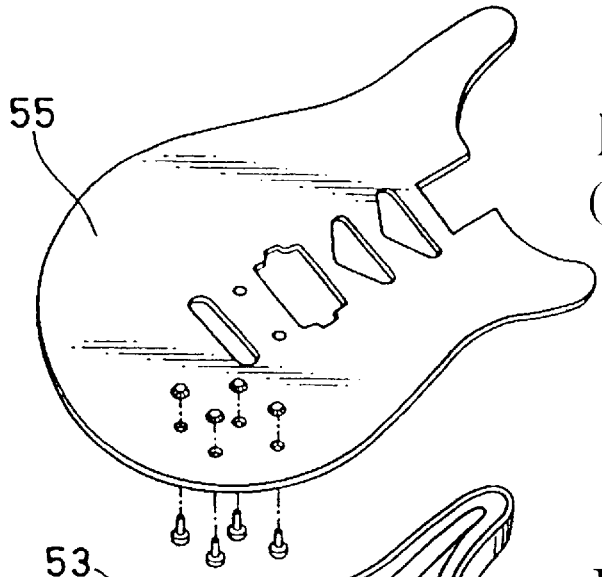
FIG. 7A (PRIOR ART)
FIG. 7A shows a perspective illustration of a front board in an exploded view of a body structure of an electric guitar of the semi-acoustic type.
Figure 7B:
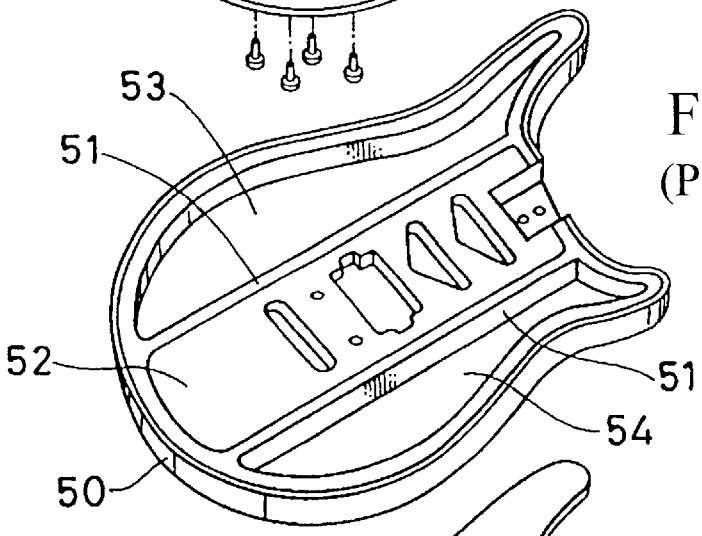
FIG. 7B (PRIOR ART)
FIG. 7B shows a perspective illustration of a body frame in which a center block is sandwiched between the ribs in the exploded view of the body structure of the electric guitar.
Figure 7C:
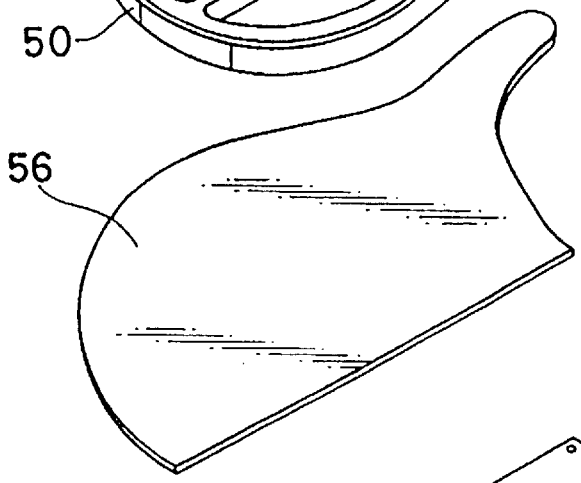
FIG. 7C (PRIOR ART)
FIG. 7C shows a perspective illustration of a back board that covers the backside of the body frame in the exploded view of the body structure of the electric guitar.
Figure 7D:
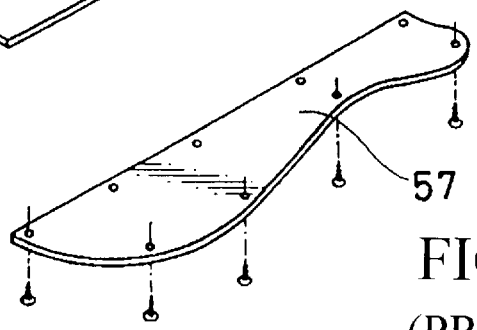
FIG. 7D (PRIOR ART)
FIG. 7D shows a perspective illustration of a back cover that covers a through hole at the backside of the body frame in the exploded view of the body structure of the electric guitar.
Figures 8A, 8B:
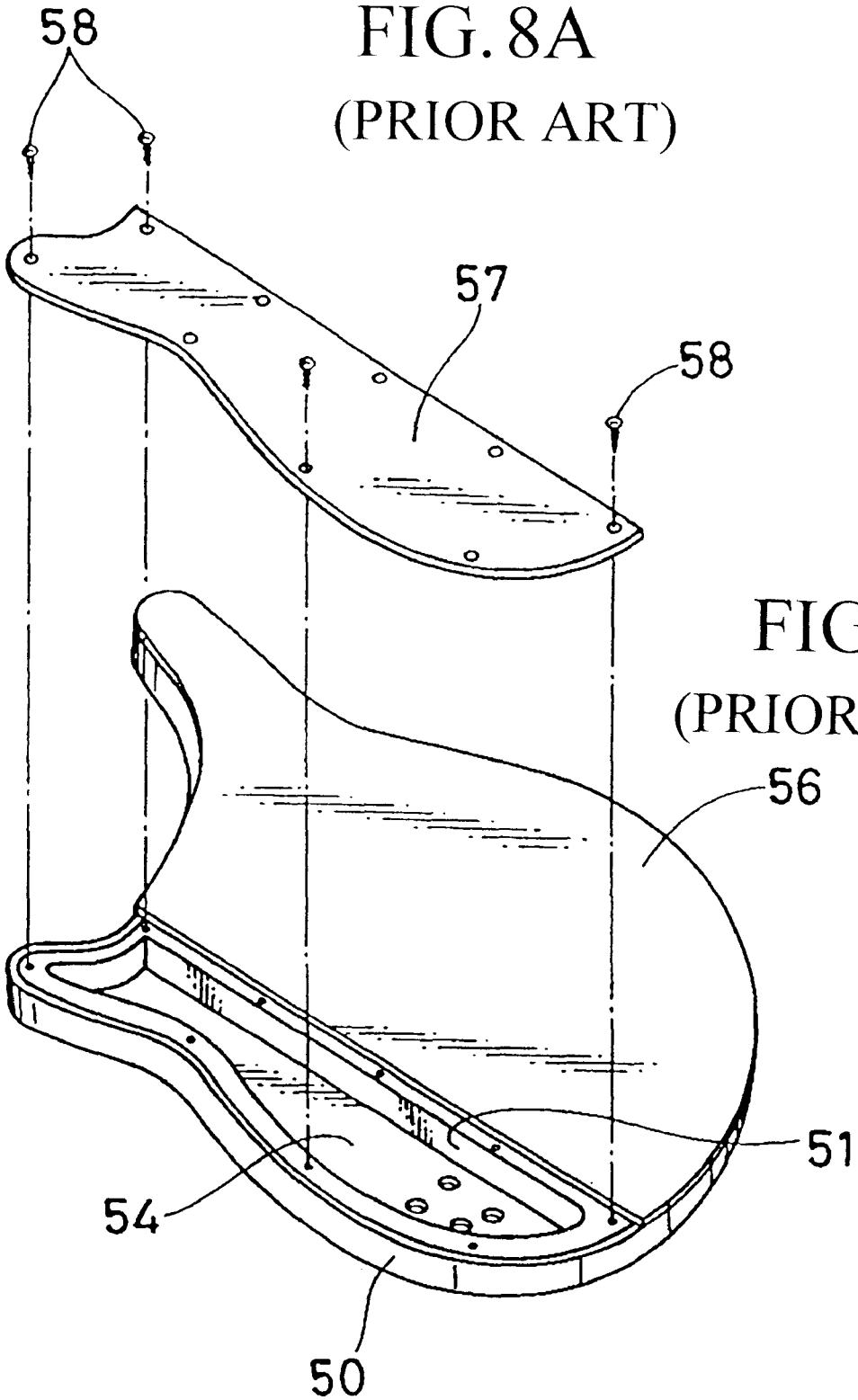
FIG. 8A (PRIOR ART)
FIG. 8B (PRIOR ART)
FIG. 8A shows a perspective illustration of the back cover in a partial exploded view of the body structure of the electric guitar.
FIG. 8B shows a perspective illustration of an assembly of the foregoing parts except for the back cover to be arranged in the partial exploded view of the body structure of the electric guitar.
Figure 9:
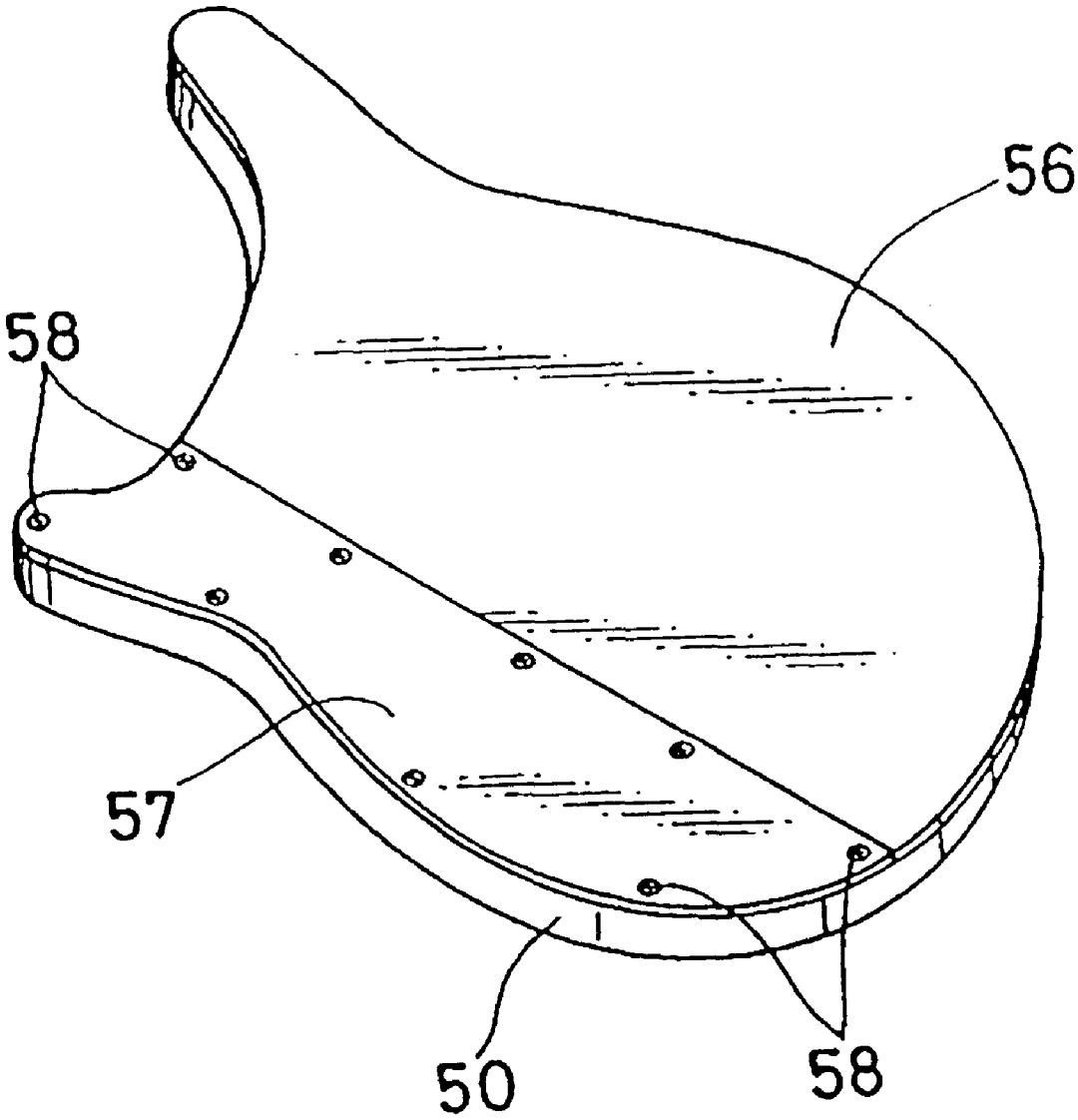
FIG. 9 (PRIOR ART)
FIG. 9 is a perspective view showing the backside of the body structure of the electric guitar in which all parts in the backside of the body structure of the electric guitar are assembled together.

FIGS. 4A to 4D show an exploded view containing perspective illustrations of the parts of a body structure corresponding to the body B of the electric guitar in accordance with a modified example of the embodiment of the invention, wherein parts identical to those shown in FIGS. 1A–1D are designated by the same reference numerals. As compared with the aforementioned embodiment, the body structure shown in FIGS. 4A–4D is partially modified such that the center block 2 is sandwiched between ribs 8 and 9, which are arranged along the longitudinal direction of the body frame 1. Using the ribs 8 and 9 inside of the body frame 1, it is possible to further improve the rigidity of the body B as a whole.

As described heretofore, this invention has a variety of effects and technical features, which are described below.

(1) According to the body structure of the stringed instrument of this invention, bridges are arranged between the center block and side portions of the body frame, so that the interior space of the body frame is partitioned to reduce the vacant space for arranging electrical parts of a stringed instrument such as an electric guitar. In addition, a back cover, which is used to cover an opening of the vacant space on the backside of the body, is reduced in size as well. In other words, it is possible to minimize the overall area of the back cover that is fixed to the backside of the body to cover the vacant space, which is restricted in area by the center block, bridge and body frame. This prevents the back cover from easily resonating with sounds produced by plucking the strings of the stringed instrument. Therefore, it is possible to avoid deterioration of the sound quality of the stringed instrument due to unwanted resonance of the back cover.

(2) Because of the arrangement of the bridges inside of the body frame, it is possible to improve the total rigidity of the body of the stringed instrument. In addition, because of the reduced size of the back cover, it is possible to improve appearance of the backside of the body of the stringed instrument.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A body structure for a stringed instrument, comprising:

a body frame;

a center block that is arranged approximately in a central area of the body frame and extending along its longitudinal direction;

a bridge connected between the center block and a side portion of the body frame, the bridge cooperating with at least the body frame to define the outer periphery of a vacant space for arranging electrical parts;

a front board completely covering a front side of the body frame;

a back board covering a back side of the body frame;

an opening formed in the back board and providing access to the vacant space; and a back cover removably covering the opening in the backboard.

2. The body structure for a stringed instrument according to claim 1 wherein the body frame and the bridge are integrally formed together by using metal material or synthetic resin.

3. The body structure for a stringed instrument according to claim 1 further comprising ribs arranged along side walls of the center block inside of the body frame, wherein the body frame, the bridge and the ribs are all integrally formed together by using metal material or synthetic resin.

4. The body structure for a stringed instrument to claim 1 wherein each of the at least one back cover is detachably attached to the back side of the body frame.

5. The body structure for a stringed instrument according to claim 1 wherein the stringed instrument is an electric guitar whose electrical parts are arranged in the vacant space.

6. The body structure for a stringed instrument according to claim 1, wherein the combination of the backboard and the cover covers the entire back side of the body frame.

7. The body structure for a stringed instrument according to claim 1, wherein the outer periphery of the vacant space is defined by the center block, the bridge and the body frame.

8. The body structure for a stringed instrument according to claim 1, further comprising a rib extending along a side wall of the center block, the outer periphery of the vacant space being defined the body frame, the bridge and the rib.

9. The body structure for a stringed instrument according to claim 1, further including electrical parts located in said vacant space.

10. The body structure for a stringed instrument according to claim 1, wherein the outer shape of the back cover matches the inner shape of the opening.

11. A stringed instrument, comprising:

a body having a prescribed shape defined by a body frame;

a center block arranged approximately in a central area of the body along its longitudinal axis;

a bridge connected between a side wall of the center block and the body frame;

a first board covering a surface of the body;

an opening in the first board an providing access to a vacant space in the body, the outer periphery of the vacant space being defined by at least the side wall of the center block, the body frame and the bridge; and a second board detachably covering the opening in the first board.

12. The stringed instrument according to claim 11 wherein the body frame and the bridge are integrally formed together by using metal material or synthetic resin.

13. A stringed instrument according to claim 11 wherein the space arranges electrical parts therein.

14. The stringed instrument according to claim 11, further comprising:

a second rib arranged approximately in a central area of the body and extending along its longitudinal axis; and a center block located between the first and second ribs and extending along the longitudinal axis of the body.

* * * * *